US005757400A

United States Patent [19]

Hoisington

[11] Patent Number: 5,757,400

[45] Date of Patent: May 26, 1998

[54] HIGH RESOLUTION MATRIX INK JET ARRANGEMENT

[75] Inventor: Paul A. Hoisington, Norwich, Vt.

[73] Assignee: Spectra, Inc., Keene, N.H.

[21] Appl. No.: 594,405

[22] Filed: Feb. 1, 1996

[51] Int. Cl.[6] ..... B41J 2/45; B41J 2/21; B41J 2/04; B41J 2/045

[52] U.S. Cl. ..... 347/40; 347/43; 347/54; 347/71

[58] Field of Search ..... 347/40, 70, 71, 347/43, 54, 65

[56] References Cited

U.S. PATENT DOCUMENTS

| | | | |
|---|---|---|---|
| 3,921,916 | 11/1975 | Bassous | 347/47 X |
| 4,455,560 | 6/1984 | Louzil | 347/71 |
| 4,766,671 | 8/1988 | Utsumi et al. | 347/71 X |
| 4,864,328 | 9/1989 | Fischbeck | 347/43 |
| 5,079,571 | 1/1992 | Eriksen . | |
| 5,087,930 | 2/1992 | Roy et al. | 347/71 X |
| 5,260,723 | 11/1993 | Naruse et al. | 347/71 |
| 5,455,615 | 10/1995 | Burr et al. | 347/92 |
| 5,630,274 | 5/1997 | Miyazawa et al. | 347/71 X |

*Primary Examiner*—David F. Yuckey
*Attorney, Agent, or Firm*—Baker & Botts, L.L.P.

[57] ABSTRACT

In the particular embodiments of the invention described in the specification, an ink jet system has a plurality of modular ink jet arrays arranged to produce high resolution images on a substrate. In one embodiment, the ink jet arrays are formed in an ink chamber plate in rows and columns providing a hexagonal pattern with ink chambers on one side of the plate and orifice passages leading from the ink chambers to an orifice plate on the opposite side of the ink chamber plate and a piezoelectric transducer mounted adjacent to the ink chambers has actuating electrodes adjacent to each of the ink chambers. Ink supply ducts, which extend in the ink chamber plate between the rows of ink jets to supply ink thereto, have one wall provided by an orifice plate affixed to the ink chamber plate.

18 Claims, 3 Drawing Sheets

HIGH RESOLUTION MATRIX INK JET ARRANGEMENT

BACKGROUND OF THE INVENTION

This invention relates to high resolution ink jet systems and, more particularly, to a high resolution ink jet arrangement utilizing a matrix ink jet array.

Heretofore, most conventional ink jet systems have been made with linear arrays of ink jet nozzles for projecting ink drops onto a substrate as the array is moved with respect to the substrate in order to form an image on the substrate. With currently available technology the nozzles in a linear array cannot be located closer together than about 0.025 inch (0.7 mm). As described in the Fishbeck U.S. Pat. No. 4,864,328 for example, in order to provide a higher resolution, i.e., image lines closer together, than the nozzle spacing in an ink jet image made with such a linear array of ink jets, the array is inclined at a relatively small angle with respect to the direction of scanning motion of an ink jet head containing the array. For example, when a linear array of ink jet nozzles which are spaced by about 0.025 inches (0.7 mm) is inclined at an angle of about 7.5° with respect to the direction of scanning motion, the resulting adjacent lines of the ink jet image are spaced by about a 0.0033 inches (0.08 mm), providing a resolution in the direction perpendicular to the scanning direction of about 300 lines per inch (12 lines per mm).

While the image resolution in the direction of the scanning motion of an ink jet head can be increased by increasing the rate of application of ink drops during the scanning motion or by reducing the rate of the scanning motion, in order to provide higher resolution in the direction perpendicular to the scanning direction using a linear ink jet array, the angle of the linear array with respect to the scanning motion of the array must be reduced, but at angles smaller than about 7.50 small errors in angular positioning of the orifice array become significant. The minimum practical angle is about 20, which would provide a maximum potential resolution of about 1200 lines per inch (48 lines per mm) using a linear array.

In order to minimize the spacing between adjacent ink jets in a linear array, the Burr et al. U.S. Pat. No. 5,455,615 discloses an ink jet arrangement in which the pressure chambers for adjacent ink jets in a linear array are disposed in two adjacent rows spaced at different distances from the ink jets to provide a hexagonal pressure chamber configuration. This arrangement requires ink to be supplied to the pressure chamber in the row closer to the ink jet array through ink ducts which pass between the pressure chambers in the row farther from the ink jet array. To provide ink ducts of the same length to all of the pressure chambers, the ink ducts leading to the pressure chambers in the row farther from the ink jet array include a curved portion. This effectively precludes the provision of two or more adjacent parallel rows of ink jets in an ink jet head. Consequently there is a need for a different arrangement of ink jets to provide higher resolution in the direction perpendicular to the scanning direction in an ink jet image.

If ink jet systems providing resolution higher than 1200 lines per inch (48 lines per mm) can be achieved, other advantages in addition to improved image quality can be provided. For example, because the ink drops applied by high resolution systems are smaller, less ink is required to provide complete coverage of a substrate even though the ink drops are closer together and, since the ink drops are applied to the substrate at a correspondingly higher frequency, greater throughput can be obtained.

SUMMARY OF THE INVENTION

Accordingly, it is an object of the present invention to provide a high resolution ink jet system which overcomes the disadvantages of the prior art.

Another object of the invention is to provide a high resolution ink jet system for which ink jet arrays can be conveniently manufactured at relatively low cost.

These and other objects of the invention are attained by providing an ink jet head having an array of ink jets arranged in the form of a matrix and spaced so that ink drops ejected from the orifices produce an image on an adjacent substrate in which image lines are spaced by at least 1200 lines per inch (48 lines per mm) in the direction perpendicular to the scanning direction. Preferably, for compactness of the ink jet head, the ink jets are arranged in a hexagonal configuration in which each ink jet, except those at the edges of the matrix, is surrounded by and substantially and uniformly spaced from six other ink jets to provide adjacent rows of ink jets in which the spacing between adjacent ink jets in each row in the direction perpendicular to the scanning motion is equal to the desired line spacing in the resulting image and the ink jets in adjacent rows in the matrix are spaced by an integral multiple of the distance equal to the inverse of the image line spacing multiplied by the number of ink jets in each row. Such an arrangement permits convenient access between adjacent columns of ink jets in the matrix array for ink supply channels of adequate size.

Preferably an ink jet array arranged in the foregoing manner includes a pumping chamber plate in which orifice passages, refill passages and pumping chambers have been formed, with an orifice plate mounted on one side of the pumping chamber plate and a piezoelectric member on the other side having actuating electrodes disposed adjacent to the pumping chambers. The pumping chamber plate is preferably formed from silicon which can be processed by photolithographic techniques or from carbon.

BRIEF DESCRIPTION OF THE DRAWINGS

Further objects and advantages of the invention will be apparent from a reading of the following description in conjunction the accompanying drawings in which.

DESCRIPTION OF PREFERRED EMBODIMENTS

Figure 1:
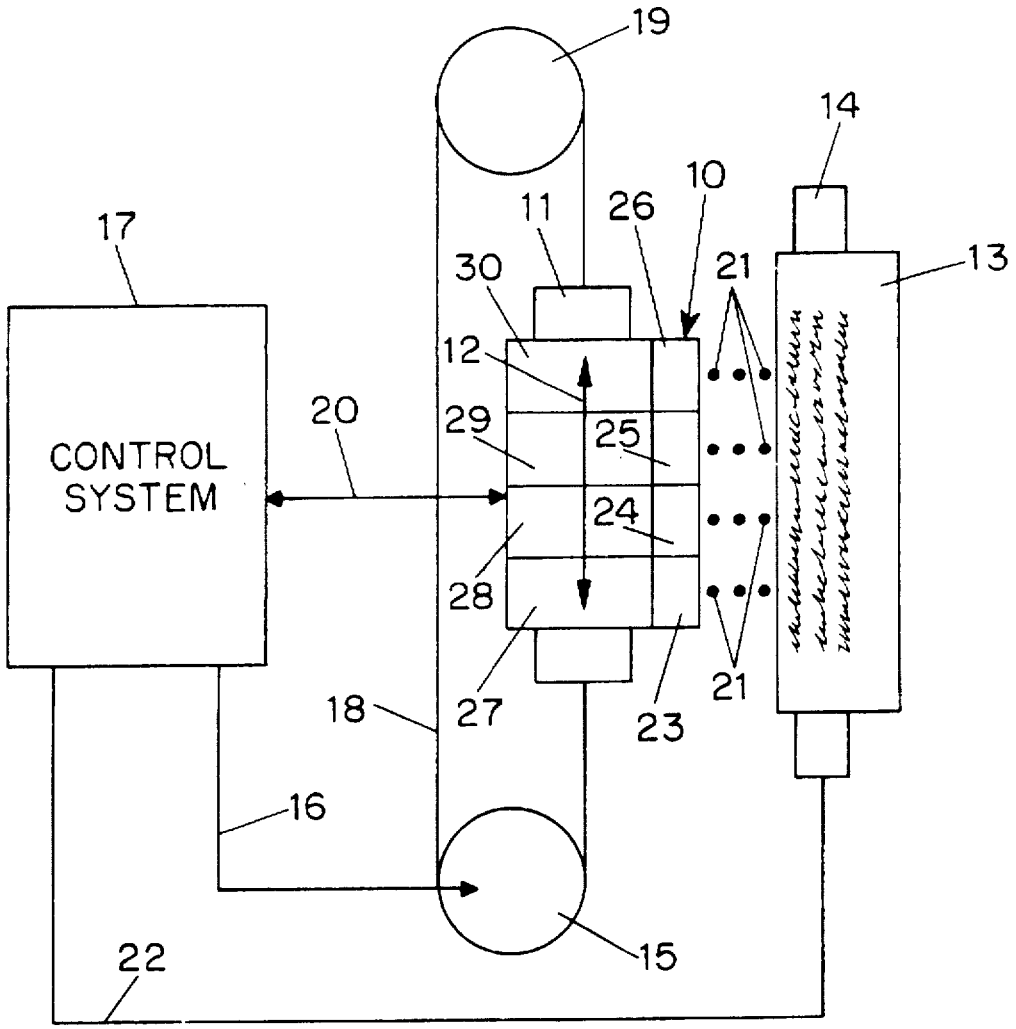
FIG. 1 is a schematic plan view illustrating the arrangement of a representative embodiment of an ink jet system containing an ink jet head with matrix arrays of ink jets in accordance with the invention.

In the typical embodiment of the invention schematically illustrated in FIGS. 1–4, an ink jet head 10 is mounted on a carriage 11 for reciprocating motion in the direction indicated by the arrow 12 adjacent to a substrate 13, such as a sheet of paper. The substrate 13 is supported on a platen 14 for motion perpendicular to the direction of motion of the carriage 11 and is advanced periodically or continuously in the usual manner. A drive spindle 15, driven by a motor in accordance with signals on a line 16 from a control system 17, drives the carriage 11 by means of a belt 18 which passes around a spindle 19 at the opposite end of the path of motion of the carriage. The control system 17 also transmits control signals on a line 20 to control selective ejection of ink drops 21 of different colors, such as black, yellow, magenta and cyan, toward the substrate 13 and further controls the motion of the substrate through a line 22 in the usual manner to produce an image on the substrate.

Figure 2:
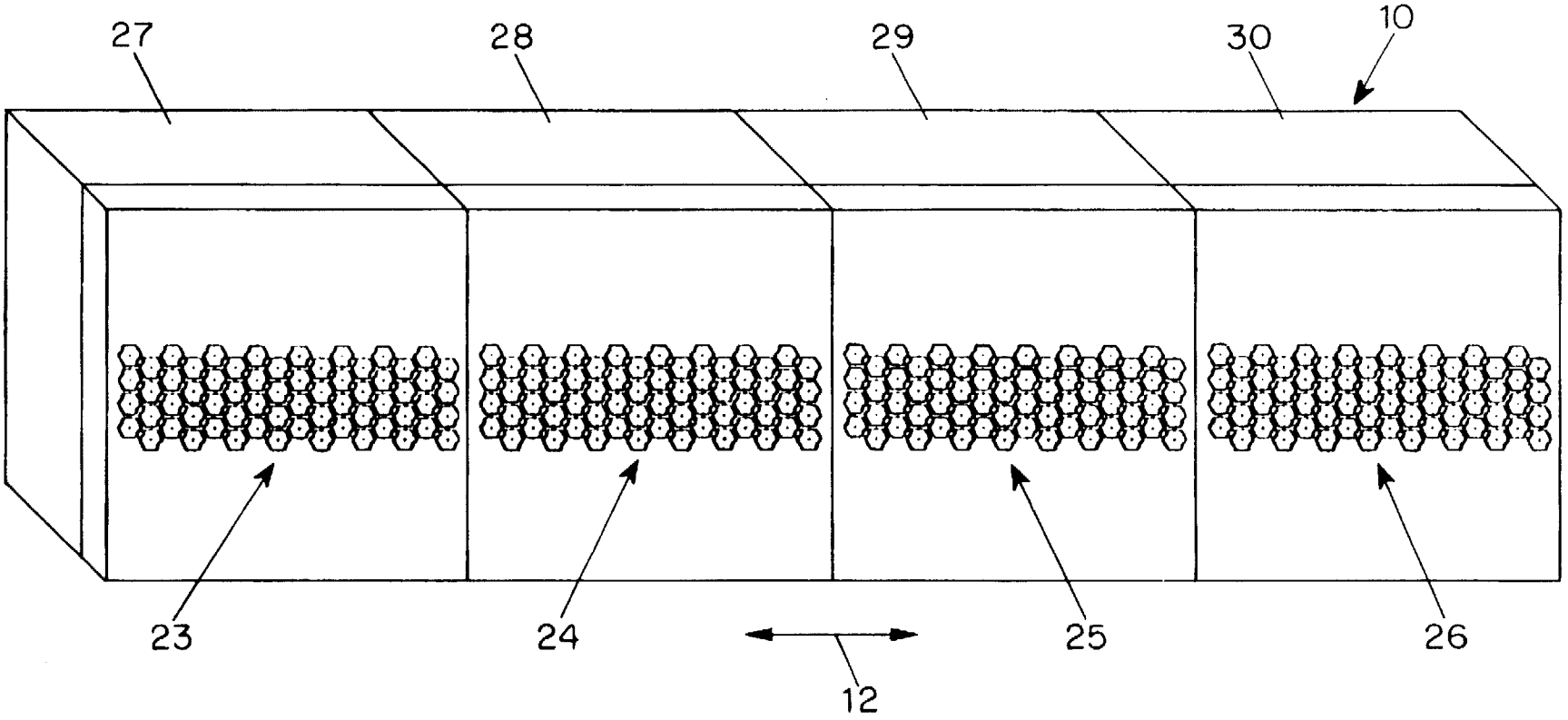
FIG. 2 is diagrammatic front perspective view showing the arrangement of a plurality of matrix ink jet modules in the ink jet head of FIG. 1.

As best seen in FIG. 2, the ink jet head 10 includes four matrix ink jet arrays 23, 24, 25 and 26 arranged to eject the different colors of ink respectively, the inks being supplied thereto from corresponding adjacent ink reservoirs 27, 28, 29 and 30 in the ink jet head 10. In the illustrated embodiment, each of the four matrix ink jet arrays 23–26 contains 64 ink jets arranged in eight rows of eight ink jets each with alternate rows being displaced by half the distance between the adjacent jets in each row. Moreover, all of the rows of ink jets in the matrix arrays are aligned with the corresponding rows in the other matrices so that, when the head 10 is reciprocated in the direction of the arrow 12, ink drops ejected from corresponding ink jets in each of the arrays during the same scan will be applied to the same image pixel on the substrate 13.

Figure 3:
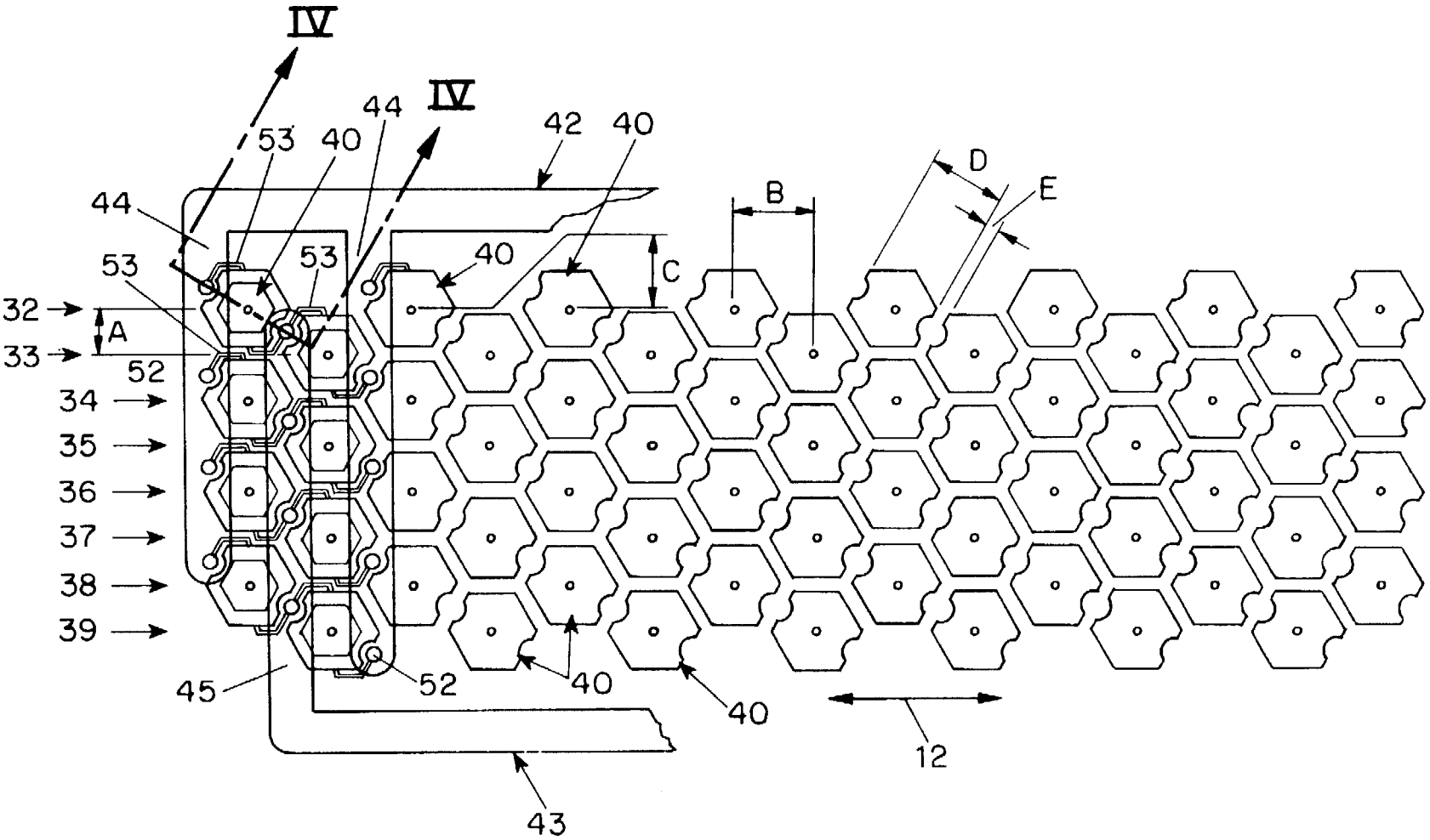
FIG. 3 is schematic plan view showing the arrangement of a representative embodiment of a matrix ink jet array in accordance with the invention.

In the enlarged view of FIG. 3, the matrix ink jet array 23 is illustrated in greater detail to show the ink supply arrangement for each of the ink jet orifices and to indicate dimensional relationships between ink jets in the matrix array. In the typical embodiment shown in FIG. 3, the matrix array includes eight parallel rows 32–39 each containing eight ink jets 40 with the ink jets in alternate rows being shifted by half the distance between adjacent ink jets in each row. This provides a hexagonal ink jet pattern with six ink jets surrounding each of the ink jets, except along the edges of the matrix array. The rows of ink jets are spaced by a distance A and the ink jets in adjacent rows are spaced in the direction of motion 12 of the array by a distance B. Moreover, successive ink jets 40 in each row are spaced in the direction perpendicular to the direction of motion 12 of the array by a distance C and each of the ink jets has a hexagonal outline with a thickness D between opposite walls and with a substantially uniform spacing E between adjacent walls of the ink jets.

For a typical embodiment of a matrix ink jet array designed to produce ink jet images having a resolution of 2400 lines per inch (96 lines per mm), the following dimensions may be used:

TABLE 1

| |
|---|
| A = 0.016667 inch (0.0423 mm) |
| B = 0.028868 inch (0.0733 mm) |
| C = 0.00041667 inch (10.6 μm) |
| D = 0.0283 inch (0.0719 mm) |
| E = 0.005 inch (0.013 mm) |

An ink jet matrix array with 64 ink jets as illustrated in FIG. 3 with the dimensions shown in Table 1 has a length of only about 0.47 inch (11.75 mm), a width of only about 0.15 inch (3.8 mm) and a thickness of only about 0.35 inch (8.9 mm), providing compact and correspondingly light weight ink jet arrangements. Using this arrangement, the substrate is advanced by a distance of 0.00333 inch (0.0846 mm) after each of the first four scans of the head across the substrate and then is advanced 0.133 inch (3.39 mm) to place the first line produced by the first row 32 of ink jets during the next scan immediately adjacent to the last line produced by the last row 39 of ink jets during the preceding scan and the same process is repeated until the complete image has been generated on the substrate 13.

Figure 4:
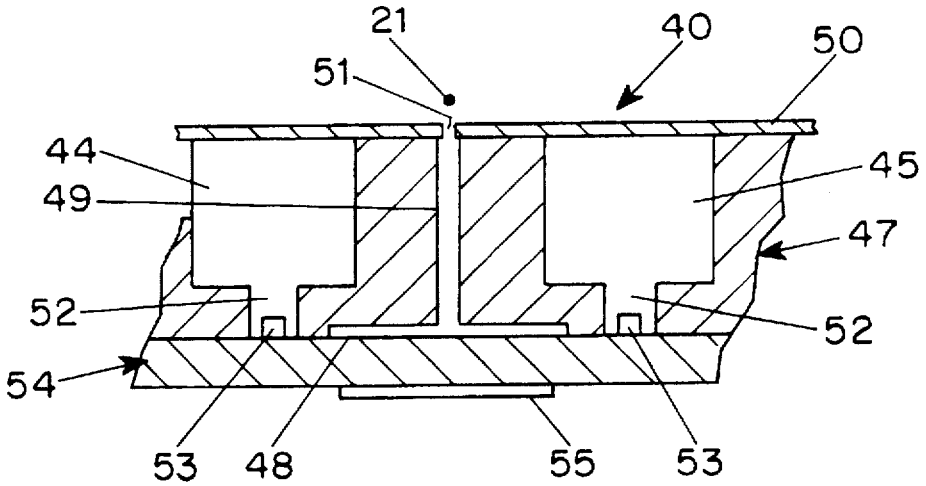
FIG. 4 is a fragmentary sectional view, taken on the line IV—IV of FIG. 3 and looking in the direction of the arrows, illustrating the arrangement of a pumping chamber and ink supply passages in the pumping chamber plate shown in FIG. 3.

With an ink jet matrix array having the dimensions set forth in Table 1 above, the supply of ink to each of the ink jets 40 from the corresponding reservoir in the ink jet head is conveniently provided by two supply ducts 42 and 43 ex-tending above and below the array, each having branches 44 and 45, respectively, which extend perpendicularly between adjacent ink jets as partially illustrated in FIG. 3 and shown in detail in the enlarged sectional view of FIG. 4. Each matrix array of ink jets 40 is formed in a common ink chamber plate 47 in which the ink supply ducts 44 and 45 extend inwardly from one surface and shallow hexagonal or circular recesses are formed in the opposite surface to provide an array of ink pumping chambers 48, each of which communicates through an orifice passage 49 with the surface in which the ducts 44 and 45 are formed.

An orifice plate 50 is affixed by adhesive on the surface of the ink chamber plate 47 in which the ducts 44 and 45 are formed so as to form one wall of the ink ducts, and at the end of each of the orifice passages 49, the orifice plate 50 has an orifice 51 through which the ink drops 21 are selectively ejected. The ducts 44 and 45 may, for example, have cross-sectional dimensions of 0.015 by 0.015 inch (0.38 by 0.38 mm) which is sufficient to assure a constant flow of ink to all of the ink jets 40 at the maximum drop ejection rate. As best seen in FIG. 3, each of the ducts 44 and 45 is connected to the adjacent pumping chambers through refill inducters 52 and corresponding passages 53 leading to the pumping chambers 48 through which each pumping chamber 48 is replenished with ink after ejecting a drop 21. In the illustrated embodiment, each of the ducts 44 and 45 supplies ink to the adjacent ink jets 40 in all of the rows 32–39 through corresponding passages 53 so that each pumping chamber 48 receives ink from both of the adjacent ducts 44 and 45.

The ink chamber plate 47 which may, for example, be about 0.02 inch (0.51 mm) thick, is preferably made of silicon and the ducts, chambers and passages therein may be formed by conventional photolithographic techniques. Alternatively, the chamber plate 47 may be a carbon plate with ducts, chambers and passages formed in the manner described in the Moynihan et al. U.S. application Ser. No. 08/406,297 filed Mar. 17, 1995, the disclosure of which is incorporated by reference herein. The orifice plate 50 may be made in the manner described in the above-mentioned U.S. application Ser. No. 08/406,297 and may be affixed to the ink chamber plate in the manner described in that application.

In order to enable selective ejection of ink drops 21, the side of the plate 47 formed with ink pumping chambers 48 is covered with a piezoelectric layer 54 which in turn is formed with an array of actuating electrodes 55 located opposite the pumping chambers 48, the actuating electrodes being arranged when selectively activated to cause the adjacent portion of the piezoelectric layer 53 to be deflected in the usual manner with respect to the corresponding chamber 48 to cause ink drop ejection through the corresponding orifice 51.

In the above-described embodiment of the invention, utilizing a matrix containing eight rows of eight ink jets and a spacing between adjacent rows which is five times the width of the image portion produced by each row during each scan, five scans of the ink jet array are required to completely fill the image area swept by the array during each scan. If desired, a matrix array having twenty ink jets in each of eight rows with the same ink jet spacing set forth in Table 1 providing an overall array length of about 1.16 inch (30 mm) may be used. In this case, only two scans are required to fill the substrate area swept by the head during each scan, the substrate being advanced 0.00833 inch (0.021 mm) after the first scan and 0.133 inch (0.846 mm) after the second scan. With this arrangement, completion of an image is effected more rapidly, leading to higher throughput. Moreover, the number of rows of ink jets in the array may be further increased, which reduces correspondingly the total number of scans required to print a full page. If the number of rows of ink jets is increased, however, the ink ducts 44 and 45 must have sufficient capacity to supply ink to all of the ink jets.

If desired, the spacing between adjacent ink jets in each row in the direction perpendicular to the scanning direction, i.e., the dimension C in FIG. 3, may be increased to provide a lower image resolution. For example the dimension C may be doubled to 0.000833 inch (21.2 μm) to provide 1200 lines per inch (48 lines per mm) resolution or increased by half to 0.000625 inch (15.9 μm) to provide 1800 lines per inch (72 lines per mm) resolution. In each case, the number of ink jets in each row and the number or scans made to complete the image portion swept by the head should be correspondingly adjusted.

For example, in another embodiment, matrix arrays containing 16 rows of ink jets with 16 ink jets in each row can be provided with the same hexagonal configuration described above and the same dimensions A, B, D and E set forth in Table 1 but with a dimension C of 0.00054 inch (0.0132 mm), providing arrays with overall dimensions of about 0.94 inch (23.5 mm) by 0.3 inch (7.6 mm).

In this embodiment a resolution of 1920 lines per inch (79 lines per mm) is produced and after the first scan, the substrate is advanced 0.00834 inch (0.212 mm) and scanned again to complete coverage of the portion of the substrate swept by the head, after which the substrate is advanced 0.133 inch (0.846 mm) to commence coverage of another segment of the substrate. In other embodiments, the other dimensions given in Table 1 may be scaled down to provide arrays with smaller overall size and weight but the ink chambers 48 must be large enough to eject ink drops of the required size at the required velocity and the ink supply ducts must be large enough to assure a continuous supply of ink to all of the ink jets at the highest drop ejection rate.

With a matrix ink jet array of the type described above, a high image resolution in the direction perpendicular to the direction of scanning is provided in a convenient and highly effective manner at low cost and with a minimum space and weight requirement. In order to provide correspondingly high resolution in the direction of scanning 12, selective actuation of the piezoelectric member 53 adjacent to each ink chamber 48 should be effected at a rate which, when considered with the scanning velocity of the ink jet head, will apply ink drops along each line of the image at substantially the same spacing as the line-to-line spacing. Thus, for example, to provide resolution in the scanning direction of 2400 drops per inch (96 drops per mm), if the ink jet head 10 is scanning at a rate of 20 inches per second (508 mm per second) the ink jet head must be capable of ejecting drops through each ink jet at a rate of approximately 48 kHz, and for a resolution of 1200 drops per inch (48 drops per mm) the drop ejection rate at the same scanning speed must be about 24 kHz. For higher head scanning speeds correspondingly higher drop ejection rates are required. Such high frequency drop ejection rates can be achieved in the manner described, for example, in the Hoisington U.S. patent application Ser. No. 08/277,101 filed Jul. 20, 1994, the disclosure of which is incorporated herein by reference.

With such high resolution ink jet systems, the ink drops applied by the ink jet head are placed closer together on the substrate and consequently must be smaller than drops which are spaced father apart on the substrate in lower resolution systems. For example, with a conventional resolution of 300 lines per inch (12 lines per mm) and corresponding resolution in the scanning direction of 300 dots per inch (12 dots per mm), each drop has a volume of about 95 picoliters and a drop diameter of about 57 μm, providing an ink layer thickness of about 13 μm for complete coverage. With a resolution of 600 dots per inch (24 dots per mm), the ink drops have a volume of about 25 picoliters and a diameter of about 36 μm and also produce a layer approximately 13 μm thick for complete coverage. At 1200 dot per inch (48 dot per mm) resolution, the ink drops have a volume of four picoliters and a diameter of about 20 μm and provide a layer thickness of about 10 μm for complete coverage, whereas at a resolution of 2400 dots per inch (96 dots per mm) the ink drops have a volume of about 0.5 picoliter and a diameter of about 10 μm, producing a layer of about 4 μm thickness for complete coverage of a substrate.

As a result of the reduction in ink layer thickness for high resolution printing, approximately 3000 pages of text may be printed using the same amount of ink required for 1000 pages of text at 300 dots per inch (12 dots per mm) or 950 pages of text at 600 dots per inch (24 dots mm). Because of the thinner ink layer, however, a higher colorant loading in the ink is required for good quality images. For example, twice the dye or pigment concentration is required for 2400 dot per inch (96 dot per mm) printing than for 300 dot per inch (12 dot per mm) and 600 dot per inch (24 dot per mm) printing. Moreover, to produce ink drops having a diameter of 10 μm, the diameter of each ink jet orifice 51 should be about 10 μm, the width of the pumping chamber 48 should be about 0.001 inch (0.025 mm), the pumping chamber diameter should be about 0.020 inch (0.5 mm) and the thickness of the piezoelectric layer 53 should be about 0.005 inch, (0.127 mm). For an ink jet array arranged to print 1200 lines per inch (48 lines per mm) with a drop size of 20 μm the orifice 51 should have a diameter of about 20 μm, the pumping chamber should have a width of about 0.0021 inch (0.053 mm) and a diameter of about 0.042 inch (1.07 mm) and the thickness of the piezoelectric layer 53 should be about 0.01 inch (0.254 mm).

In contrast to the foregoing, if an attempt were made to design a linear type ink jet array to produce ink drops of 20 μm or 10 μm diameter, it would be necessary to provide a piezoelectric member having a thickness of 0.0017 inch (43 μm) capable of ejecting drops from a chamber having dimensions of 0.006 inch (0.15 mm) by 0.028 inch (0.71 mm) or one with a thickness of 0.0035 inch (86 μm) capable of ejecting drops from a chamber having dimensions of 0.012 inch (0.3 mm) by 0.083 inch (2.1 mm). With the present piezoelectric fabrication technology, it would not be possible to produce piezoelectric members which would have sufficient strength to eject ink drops from such chambers at the desired rate and velocity, whereas piezoelectric members having the dimensions specified above for ink jet matrix array piezoelectric member can be made to eject ink drops at the required rate and velocity.

Because of the smaller orifice diameter and drop size required for high resolution ink jet systems of the type described herein, additional precautions may be necessary. For example, finer filtration of the ink may be necessary to remove particles having a diameter of 1.5 μm to 3 μm in contrast to 8 μm to 9 μm particle filtration for lower resolution systems. Moreover, because the smaller volume ink drops in high resolution systems cool more rapidly after ejection, care must be taken to make certain that the ambient temperature conditions in the region between the ink jet head and the substrate are capable of assuring that the drop does not solidify before it reaches the substrate. The smaller drop volume also increases the deceleration of the drop by air resistance in the space between the ink jet head and the substrate, which may require adjustments in the timing of drop ejection to cause drops to arrive at the proper locations in the image on the substrate.

Although the invention has been described herein with reference to specific embodiments, many modifications and variations therein will readily occur to those skilled in the art. Accordingly, all such variations and modifications are included within the intended scope of the invention.

I claim:

1. A high resolution ink jet system comprising an ink jet head, drive means for providing a scanning motion between the ink jet head and a substrate, an array of ink jets in the ink jet head arranged in matrix form containing at least three adjacent parallel rows of the ink jets, each row of the adjacent parallel rows including a number of the ink jets and extending substantially parallel to a direction of scanning motion, the ink jets including an array of ink chambers and a plurality of orifice passages, an ink chamber plate in the ink jet head having an ink chamber side and an orifice side and having the array of ink chambers formed on the ink chamber side, the plurality of orifice passages extending through the ink chamber plate, each leading from one of the ink chambers to the orifice side of the ink chamber plate, an orifice plate affixed to the orifice side of the ink chamber plate and having an array of orifices each communicating with one of the orifice passages, each of the ink chambers in the array being spaced from a corresponding one of the array of orifices by a distance which is identical for all of the ink chambers in the array, a plurality of ink supply ducts extending within the ink chamber plate transversely to the adjacent parallel rows of ink jets, a plurality of ink passages connecting each of the ink chambers with at least one of the ink ducts, and a piezoelectric member affixed to the ink chamber side of the ink chamber plate and having an array of actuating electrodes disposed at locations corresponding to locations of the ink chambers in the ink chamber plate.

2. An ink jet system according to claim 1 wherein the ink jets in the array are arranged in a hexagonal configuration.

3. An ink jet system according to claim 1 wherein the ink jet system has a line spacing and the ink jets in each row of the adjacent parallel rows are spaced in a direction perpendicular to the direction of scanning motion by a distance equal to the line spacing.

4. An ink jet system according to claim 3 wherein a spacing between the adjacent rows of ink jets is an integral multiple of the spacing of adjacent ink jets in each row of the adjacent parallel rows in the direction perpendicular to the scanning direction multiplied by a number of ink jets in each row of the adjacent parallel rows.

5. An ink jet system according to claim 3 wherein the spacing of adjacent ink jets in the direction perpendicular to the direction of scanning motion of the ink jet head is no more than about 0.000833 inch (21.2 μm).

6. An ink jet system according to claim 1 wherein the piezoelectric member is a piezoelectric layer having a thickness no more than about 0.01 inch (0.25 mm) and each of the each ink chamber in the ink chambers plate has a maximum dimension of no more than about 0.05 inch (1.25 mm).

7. An ink jet system according to claim 1 wherein the ink chamber plate is made of a material processed by photolithography.

8. An ink jet system according to claim 1 wherein the chamber plate is made of silicon.

9. An ink jet system according to claim 1 wherein the ink chamber plate is made of carbon.

10. An ink jet system according to claim 1, including control means for controlling selective ejection of ink drops from the ink jets at a rate of at least 24 kHz.

11. An ink jet system according to claim 1 wherein the ink jets in each row of the adjacent parallel rows are spaced to provide a minimum resolution in a printed image of at least 1200 lines per inch (48 lines per mm).

12. An ink jet system according to claim 1, including a plurality of matrix ink jet arrays in the ink jet head and a plurality of ink reservoirs in the ink jet head for supplying a different color of ink to each of the arrays.

13. An ink jet system according to claim 1 wherein each ink chamber has a hexagonal peripheral shape.

14. An ink jet system according to claim 1 wherein each ink chamber has a circular peripheral shape.

15. An ink jet system according to claim 1 wherein the ink jet array comprises at least eight adjacent parallel rows of the ink jets with each row of the adjacent parallel rows containing at least eight of the ink jets and the ink jets in each row of the adjacent parallel rows are spaced in the scanning direction from the ink jets in an adjacent row by approximately half the spacing between adjacent ink jets in each row of the adjacent parallel rows.

16. An ink jet head comprising an ink chamber plate having an ink chamber side and an orifice side, a plurality of rows of ink jets including an array of ink chambers and a plurality of orifice passages, the array of ink chambers being arranged in at least three rows and at least three columns formed in the ink chamber side of the ink chamber plate, the plurality of orifice passages extending through the ink chamber plate, each leading from one of the ink chambers to one of an array of orifices on the orifice side of the ink chamber plate, a plurality of ink supply ducts formed in the ink chamber plate, each ink supply duct in the plurality of ink supply ducts extending between adjacent rows of the ink jets, each of the ink chambers in the array being spaced from a corresponding one of the array of orifices by a distance which is identical for all of the ink chambers in the array, and a plurality of ink passages connecting each of the ink chambers with at least one of the ink supply ducts.

17. An ink jet head according to claim 16 wherein the ink supply ducts are formed in the orifice side of the ink chamber plate and including an orifice plate affixed to the orifice side of the ink chamber plate to form one wall of the ink supply ducts and having an array of orifices each communicating with one of the orifice passages.

18. An ink jet head according to claim 16 including a piezoelectric member affixed to the ink chamber side of the chamber plate and having an array of actuating electrodes disposed at locations corresponding to the locations of the ink chambers in the ink chamber plate.

* * * * *